United States Patent [19]

Nojima

[11] Patent Number: 4,972,743

[45] Date of Patent: Nov. 27, 1990

[54] APPARATUS FOR FEEDING SHEETS

[75] Inventor: Yoshio Nojima, Kanagawa, Japan

[73] Assignee: Fuji Photo Film Co., Ltd., Kanagawa, Japan

[21] Appl. No.: 352,429

[22] Filed: May 16, 1989

[30] Foreign Application Priority Data

May 16, 1988 [JP] Japan ..... 63-118500

[51] Int. Cl.[5] ..... B26D 5/20

[52] U.S. Cl. ..... 83/76.8; 83/156; 83/209; 83/289; 83/358; 83/367

[58] Field of Search ..... 83/76.6, 76.7, 76.8, 83/72, 73, 209, 289, 298, 359, 365, 367, 370, 156, 358, 313

[56] References Cited

U.S. PATENT DOCUMENTS

| | | | |
|---|---|---|---|
| 3,614,572 | 10/1971 | Usher | 83/360 |
| 3,933,069 | 1/1976 | Tall et al. | 83/365 X |
| 4,380,943 | 4/1983 | Evans | 83/298 X |
| 4,534,253 | 8/1985 | Seragnoli | 83/365 X |
| 4,574,563 | 3/1986 | Shimizu | 83/367 X |
| 4,809,573 | 3/1989 | Welch | 83/76.8 X |

*Primary Examiner*—Frank T. Yost
*Assistant Examiner*—Rinaldi Rada
*Attorney, Agent, or Firm*—Sughrue, Mion, Zinn, Macpeak & Seas

[57] ABSTRACT

An apparatus for feeding sheets comprises a variable speed conveyor for feeding a sheet cut from a web. A high speed conveyor receives the sheet fed by the variable speed conveyor, and feeds it at a high speed v1. A cutting completion detector detects the separation of the sheet from a cutter and generates a detection signal. A controller adjusts the feeding speed of the variable speed conveyor to a feed speed v2 as long as the leading portion of the web is being fed to the cutter, adjusts the feeding speed to a speed v0 (v0<v1, v2), at which the sheet is kept stationary with respect to the cutter, during the time from when the cutter starts cutting the web to when the cutting is finished and the cut sheet separates from the cutter, and increases the feeding speed from the speed v0 to the speed v1 during the time from when the detection signal is generated to when the sheet arrives at the high speed conveyor.

2 Claims, 3 Drawing Sheets

APPARATUS FOR FEEDING SHEETS

BACKGROUND OF THE INVENTION

1. Field of the Invention

This invention relates to an apparatus for feeding sheets which have been cut sequentially from a long web.

2. Description of the Prior Art

In general, in processes for making sheets of photographic film such as 35 mm film, a long film web is fed along its longitudinal direction and cut sequentially into sheets of film having predetermined lengths, for example, 24-frame rolls of film or 36-frame rolls of film. The techniques for feeding a long web in its longitudinal direction in order to feed the long web to a fixed type cutter or to a moving type cutter, which cuts the web while it is moving at a speed equal to its feeding speed, and sequentially cutting the web with the cutter into sheets are widely used in various fields as well as in processes for making sheets of photographic film. One of such techniques has been disclosed in Japanese Unexamined Patent Publication No. 59(1984)-4548.

In cases where a fixed type cutter is used, the feeding of the web is stopped when the web is to be cut. In cases where a moving type cutter is used, though the speed at which the web is fed cannot be increased very much, it is required that the sheet which has been cut from the web be fed quickly into the subsequent process. Therefore, in both cases, the speed at which the sheet is fed changes midway during the feeding. As a result, the sheet slips along the feeding means such as feed rollers.

FIGS. 3A and 3B are schematic views showing an example of a conventional apparatus for feeding sheets wherein a fixed type cutter is used. The aforesaid problem will be described hereinbelow with reference to FIGS. 3A and 3B. A web 50, which is wound around a supply roller 51, is intermittently unwound and fed toward a cutter 53 by intermittent feed rollers 52, 52 until a leading portion of the web 50, which portion has a predetermined length, is located on the downstream side of the cutter 53 as viewed in the direction along which the web 50 is fed. This process occurs intermittently, each time the web 50 is to be fed forward. High speed feed rollers 54A, 54A, 54B, 54B, 54C, 54C which are rotated at equal speeds are provided on the downstream side of the cutter 53 as viewed in the direction along which the web 50 is fed.

As shown in FIG. 3A, immediately before the web 50 is cut, the unwound portion of the web 50 is held by the intermittent feed rollers 52, 52 and the high speed feed rollers 54A, 54A. At this time, the rotation of the intermittent feed rollers 52, 52 is stopped and the unwound portion of the web 50 is held in a stationary state, whereas the high speed feed rollers 54A, 54A continue to be rotated quickly. Therefore, the portion of the web 50 which is grasped by the high speed feeding rollers 54A, 54A slips along the high speed feed rollers 54A, 54A until the cutting of the web 50 is finished.

Also, as shown in FIG. 3B, a sheet 50A which has been cut from the web 50 is accelerated from a standstill to a predetermined feeding speed when the sheet 50A moves from the high speed feed rollers 54A, 54A to the high speed feed rollers 54B, 54B and then to the high speed feed rollers 54C, 54C. During the acceleration of the sheet 50A, the sheet 50A inevitably slips along the rollers because the high speed feed rollers 54A, 54A, 54B, 54B, 54C, 54C are being rotated at constant speeds.

When the sheet 50A slips along the rollers, it is often scratched by the rollers. In cases where the sheet 50A is photographic film or the like, scratches on the sheet 50A render the sheet 50A unmarketable.

One approach used to prevent the sheet 50A from being scratched is to decrease the nip pressures of the high speed feed rollers 54A, 54A, 54B, 54B, 54C, 54C. However, with this approach, the speed at which the sheet 50A is fed by the high speed feed rollers 54A, 54A, 54B, 54B, 54C, 54C fluctuates during the process for making the sheets. As a result, the time required for the sheet 50A to arrive at the position where the subsequent process is carried out fluctuates. In cases where the subsequent process is carried out with an automatic machine, fluctuations in the time required for the sheet 50A to arrive at the position where the subsequent process is carried out adversely affect the normal operation of the automatic machine. Particularly, in cases where a plurality of webs are fed in parallel and simultaneously cut into sheets and the resulting sheets are fed into the subsequent process in which a plurality of the sheets are simultaneously processed with an automatic machine, very serious problems arise when the time required for each sheet to arrive at the position where the subsequent process is carried out fluctuates.

SUMMARY OF THE INVENTION

The primary object of the present invention is to provide an apparatus for feeding sheets so that the sheets do not slip along the feeding means.

Another object of the present invention is to provide an apparatus for feeding sheets wherein the sheets are fed quickly and are not scratched by the feeding means.

In the apparatus for feeding sheets in accordance with the present invention, a long web is fed along its longitudinal direction to a fixed type cutter or a moving type cutter and is cut sequentially by the cutter into sheets, and the sheets are then discharged from the apparatus. A variable speed feeding means is provided between the cutter and a high speed feeding means. The variable speed feeding means gradually increases the speed, at which the sheet is fed, up to a speed equal to the feeding speed of the high speed feeding means.

Specifically, the present invention provides an apparatus for feeding sheets in which a long web is fed along its longitudinal direction to a fixed type cutter or a moving type cutter and is cut sequentially by the cutter into sheets, and the sheets are discharged sequentially from the apparatus, the apparatus for feeding sheets comprising:

(i) a variable speed feeding means for holding the leading portion of said web, which portion is being cut, on the downstream side of said cutter as viewed in the direction along which said web is fed, and feeding each sheet so that the speed at which the sheet is fed can be varied, (ii) a high speed feeding means for receiving said sheet after it has been fed by said variable speed feeding means and feeding said sheet at a predetermined speed v1 which is comparatively high, (iii) a cutting completion detecting means for detecting the separation of said sheet from said cutter and generating a detection signal, and (iv) a feeding speed control means for adjusting the feeding speed of said variable speed feeding means to a feed speed v2 as long as the leading portion of said web is being fed to said cutter, adjusting the feeding speed of said variable speed feeding means to a speed v0 (v0<v1, v2), at which said sheet is kept stationary with respect to said cutter, during the time from when said cutter starts cutting the leading portion of said web to when the cutting is finished and the sheet which has been cut from said web separates from said cutter, and increasing the feeding speed of said variable speed feeding means from the speed v0 to the speed v1 during the time from when said detection signal is generated to when said sheet arrives at said high speed feeding means.

With the apparatus for feeding sheets in accordance with the present invention, the variable speed feeding means is provided between the cutter and the high speed feeding means so that it gradually increases the speed, at which the sheet is fed, up to the speed equal to the feeding speed of the high speed feeding means. Therefore, the sheet is reliably prevented from slipping along the feeding means and from being scratched thereby. Also, the time required for the sheet which has been cut from the web to arrive at the position where the subsequent process is carried out can be prevented from fluctuating, and therefore automation of the subsequent process is facilitated.

BRIEF DESCRIPTION OF THE DRAWINGS

FIG. 1A is a schematic view showing part of the embodiment of FIG. 1A wherein a sheet is being fed.

DESCRIPTION OF THE PREFERRED EMBODIMENTS

The present invention will hereinbelow be described in further detail with reference to the accompanying drawings.

Figure 1A:
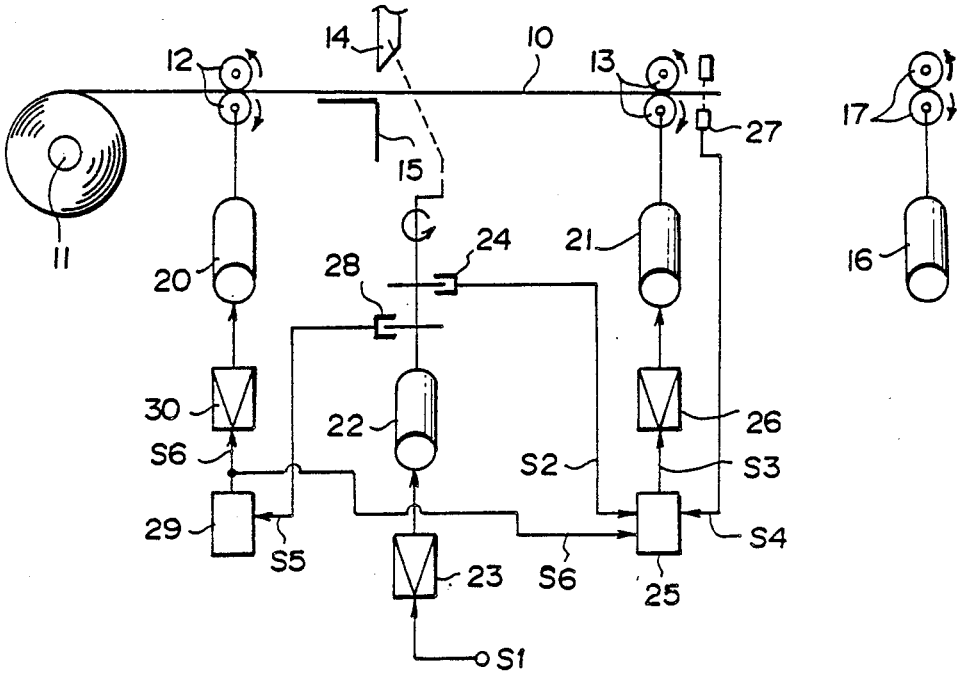
FIG. 1A is a schematic view showing an embodiment of the apparatus for feeding sheets in accordance with the present invention.

With reference to FIG. 1A, a long photographic film web 10 is stored around a supply roller 11. The photographic film web 10 is unwound from the supply roller 11, and is caused to pass between feed out rollers 12, 12, which constitute a pair of nip rollers, and between first feed rollers 13, 13. A cutter composed of an upper blade 14 and a lower blade 15 is located between the feed out rollers 12, 12 and the first feed rollers 13, 13. Second feed rollers 17, 17 which are rotated by an induction motor 16 at a predetermined, comparatively high circumferential speed v1, are located on the downstream side (the right side in FIG. 1A) of the first feed rollers 13, 13, as viewed in the direction along which the photographic film web 10 is fed. The feed out rollers 12, 12 and the first feed rollers 13, 13 are respectively rotated by servo motors 20 and 21 in the directions indicated by the arrows. The upper blade 14 of the cutter is repeatedly moved up and down by a cutter operating motor 22 which is rotated continuously. The upper blade 14 and the lower blade 15 are not moved in the direction along which the photographic film web 10 is fed.

Figure 1B:
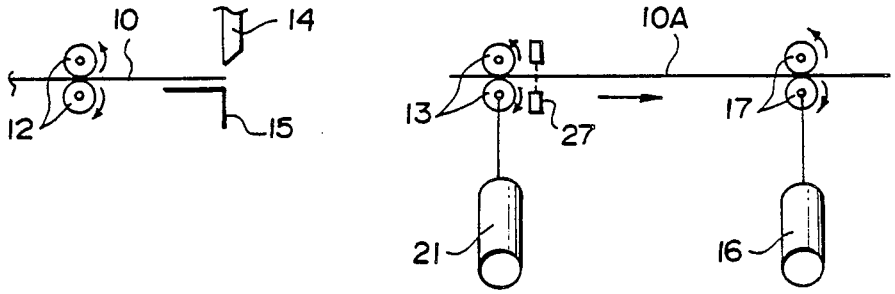
Figure 2:
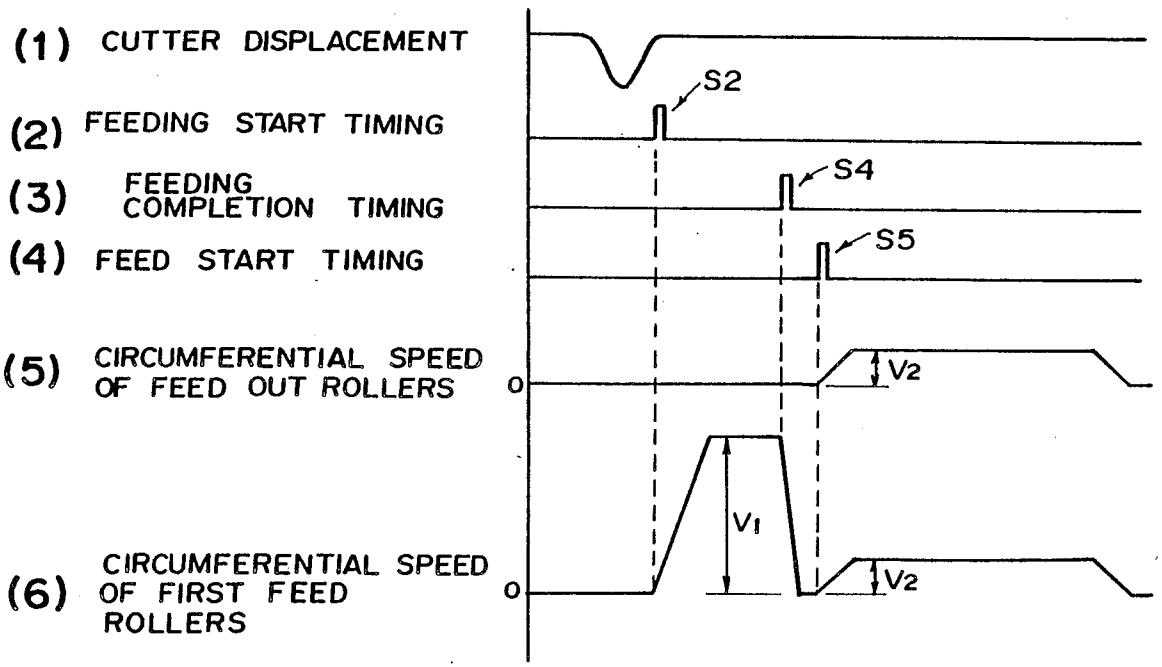
FIG. 2 is a timing chart showing the operation timing of the parts of the embodiment of FIG. 1A, and FIGS. 3A and 3B are schematic views showing an example of a conventional apparatus for feeding sheets.
Figure 3A:
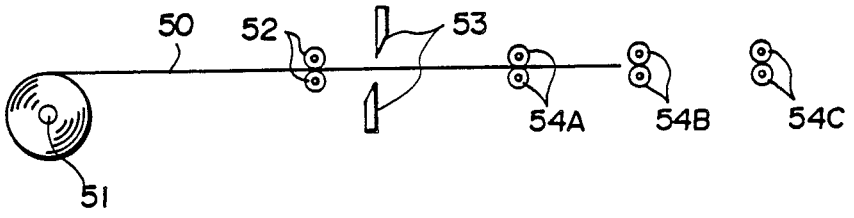
FIG.3A PRIOR ART
Figure 3B:
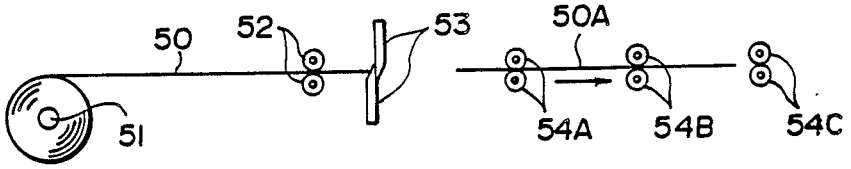
FIG.3B PRIOR ART

As shown in FIG. 1A, when the leading portion of the photographic film web 10 is being cut, it is grasped by the first feed rollers 13, 13, which are not being rotated. At this time, the feed out rollers 12, 12 also are not being rotated. When the upper blade 14 of the cutter is moved down by the motor 22, the leading portion of the photographic film web 10 is cut by the upper blade 14 and the lower blade 15. In this manner, a predetermined length of film 10A is cut as a sheet from the photographic film web 10. The predetermined length of film 10A which has been cut from the photographic film web 10 is shown in FIG. 1B. The length of the predetermined length of film 10A is adjusted so that it can be accommodated as a 24-frame roll of film, a 36-frame roll of film or the like in patrones for cameras. When the upper blade 14 is moved up from the predetermined length of film 10A after cutting it from the photographic film web 10, the separation of the upper blade 14 from the predetermined length of film 10A is detected by a cutting completion detecting means 24, and the cutting completion detecting means 24 generates a detection signal S2. The displacement of the upper blade 14 and the output timing of the detection signal S2 are indicated respectively at (1) and (2) in FIG. 2. By way of example, the cutting completion detecting means 24 detects the position of a rotation mechanism provided between the motor 22 and the upper blade 14 and thereby detects the position of the upper blade 14.

The detection signal S2 is fed into a controller 25 which acts as a feeding speed control means. Upon receiving the detection signal S2, the controller 25 feeds an operation signal S3 to a servo motor operating circuit 26 in order to activate the servo motor 21. As a result, the predetermined length of film 10A is fed by the first feed rollers 13, 13 to the second feed rollers 17, 17. The rotation speed of the servo motor 21 is controlled so that the circumferential speeds of the first feed rollers 13, 13 (i.e., the speed at which the predetermined length of film 10A is fed) gradually increase to the speed v1, which is equal to the circumferential speeds of the second feed rollers 17, 17, and thereafter are kept at the speed v1. Also, the rotation speed of the servo motor 21 is controlled so that the circumferential speeds of the first feed rollers 13, 13 reach the speed v1 before the leading edge of the predetermined length of film 10A arrives at the second feed rollers 17, 17 as shown in FIG. 1B. The change in the speed at which the predetermined length of film 10A is fed by the first feed rollers 13, 13 is indicated at (6) in FIG. 2.

Because the circumferential speeds of the first feed rollers 13, 13 are controlled in the manner described above, the feeding speed of the first feed rollers 13, 13 becomes equal to the feeding speed of the second feed rollers 17, 17 when the predetermined length of film 10A arrives at the second feed rollers 17, 17. Therefore, the predetermined length of film 10A does not slip along the first feed rollers 13, 13 and the second feed rollers 17, 17. Also, because the first feed rollers 13, 13 are not rotated till the predetermined length of film 10A has been completely cut from the photographic film web 10, the leading edge portion of the predetermined length of film 10A does not slip along the first feed rollers 13, 13. The predetermined length of film 10A is thereafter quickly fed by the second feed rollers 17, 17, which are rotated quickly, to the position where the subsequent process is carried out.

A timing detection means 27 which may be constituted by a photoelectric sensor or the like detects the time of completion of feeding in the vicinity of the first feed rollers 13, 13 on the downstream side thereof as viewed in the direction along which the predetermined length of film 10A is fed. The timing detection means 27 generates a feeding completion signal S4 as indicated at (3) in FIG. 2 when the tailing edge of the predetermined length of film 10A fed in the manner described above has passed through the timing detection means 27. The feeding completion signal S4 is fed into the controller 25. Upon receiving the feeding completion signal S4, the controller 25 stops the operation of the servo motor 21. As a result, as indicated at (6) in FIG. 2, the circumferential speeds of the first feed rollers 13, 13 decrease from v1 to 0 (zero). Thereafter a start timing detection means 28 of the same type as the cutting completion detecting mean 24 detects that the upper blade 14 has been moved to a predetermined vertical position, and generates a feed command signal S5 as indicated at (4) in FIG. 2. The feed command signal S is fed into a feed controller 29. Upon receiving the feed command signal S5, the feed controller 29 feeds an operating signal S6 to an operating circuit 30, which operates the servo motor 20 at a predetermined speed for a predetermined time. As a result, the feed out rollers 12, 12 are rotated at a predetermined circumferential speed v2 for the predetermined time as indicated at (5) in FIG. 2. The operating signal S6 is also fed into the controller 25. Upon receiving the operating signal S6, the controller 25 rotates the servo motor 21 at a predetermined speed for the predetermined time in order to rotate the first feed rollers 13, 13 at the circumferential speed v2. In this manner, a predetermined length of the next leading portion of the photographic film web 10, which is equal to the predetermined length of film 10A, is fed and cut thereafter from the photographic film web 10. As shown in FIG. 1A, the leading portion of the photographic film web 10 thus fed is then grasped by the first feed rollers 13, 13 and stopped. Thereafter, the operations described above are repeated in order to sequentially cut predetermined lengths of film 10A from the photographic film web 10 and convey them sequentially to where the subsequent process is carried out.

By way of example, the cutter operating motor 22 is constituted by a servo motor, and the rotation speed thereof is controlled by a motor operation control circuit 23. The motor operation control circuit 23 receives a line speed command signal S1, and changes the rotation speed of the motor 22 on the basis of the line speed command signal S1, thereby controlling the line speed. Specifically, the period with which the upper blade 14 is moved up and down decreases, and consequently the line speed increases, as the rotation speed of the motor 22 is increased.

In the aforesaid embodiment, a fixed type cutter is used. However, the apparatus for feeding sheets in accordance with the present invention is also applicable when a web is cut with a moving type cutter. In such cases, the feeding speed of the variable speed feeding means is set to the speed v0, which is equal to the movement speed of the cutter, until the sheet is cut completely from the web. Stated differently, the speed v0 means the speed at which the sheet is kept stationary with respect to the cutter. The speed v0 is adjusted to be lower than the feeding speed v1 of the high speed feeding means.

Also, a plurality of variable speed feeding means may be provided on the upstream side of the high speed feeding means as viewed in the direction along which the web is fed. With this configuration, the lengths of the sheets into which the web is cut can be varied. Moreover, the apparatus for feeding sheets in accordance with the present invention is also applicable when a plurality of webs are cut simultaneously. In such cases, a plurality of variable speed feeding means and/or a plurality of the high speed feeding means for the respective webs should preferably be interlocked with one another so that the times required for the sheets which have been cut from the webs to arrive at the positions where the subsequent processes are carried out are uniform among the lines for the webs.

I claim:

1. An apparatus for feeding sheets in which a long web is fed along its longitudinal direction to a cutter and is cut sequentially by the cutter into sheets, and the sheets are discharged sequentially from the apparatus, the apparatus for feeding sheets comprising:

(i) a variable speed feeding means for holding an edge portion of a leading portion of said web on the downstream side of said cutter as viewed in the direction along which said web is fed, and for feeding each sheet after being cut so that the speed at which the sheet is fed can be varied, (ii) a high speed feeding means for receiving said sheet after it has been fed by said variable speed feeding means and feeding said sheet at a predetermined speed v1, (iii) a cutting completion detecting means for detecting when said cutter moves away from said sheet and generating a detection signal, and (iv) a feeding speed control means for adjusting the feeding speed of said variable speed feeding means to a feed speed v2 as long as the leading portion of said web is being fed to said cutter, adjusting the feeding speed of said variable speed feeding means to a speed v0 (wherein v0 is less than v1, v2 and further wherein the speed v1 is comparatively high with respect to the speed v2, at which said sheet is kept stationary with respect to said cutter, during the time from when said cutter starts cutting the leading portion of said web to when the cutting is finished and said cutter moves away from the sheet which has been cut from said web, and increasing the feeding speed of said variable speed feeding means from the speed v0 to the speed v1 during the time from when said detection signal is generated to when said sheet arrives at said high speed feeding means, to attendantly prevent said sheet from slipping along said high speed feeding means and being scratched thereby.

2. An apparatus as defined in claim 1 wherein said web is a photographic film web.

* * * * *